United States Patent [19]

Pommier et al.

[11] Patent Number: 5,039,378

[45] Date of Patent: Aug. 13, 1991

[54] TWO LAYER PAPER PRODUCT FOR PRINTING

[75] Inventors: Jean-Claude Pommier, Gradignan; Joel Poustis, Pessac, both of France

[73] Assignee: La Cellulose du Pin, Bordeaux, France

[21] Appl. No.: 39,076

[22] Filed: Apr. 16, 1987

[51] Int. Cl.[5] ..... D21H 19/40; D21H 17/68

[52] U.S. Cl. ..... 162/128; 162/129; 162/130; 162/147; 162/181.8; 428/323; 428/342; 428/535

[58] Field of Search ..... 162/123, 125, 128, 129, 162/130, 147, 181.8; 428/283, 288, 289, 284, 323, 342, 386, 535

[56] References Cited

U.S. PATENT DOCUMENTS

| | | | |
|---|---|---|---|
| 2,599,092 | 6/1952 | Craig | 162/128 |
| 2,881,669 | 4/1959 | Thomas et al. | 162/130 |
| 3,227,607 | 1/1966 | Mays et al. | 162/181.6 |
| 3,406,088 | 10/1968 | Stengle et al. | 162/125 |
| 4,210,488 | 7/1980 | Reuss et al. | 162/181.4 |
| 4,510,020 | 4/1985 | Green et al. | 162/182 |

FOREIGN PATENT DOCUMENTS

| | | | |
|---|---|---|---|
| 2725200 | 12/1977 | Fed. Rep. of Germany | 162/129 |
| 2396831 | 3/1979 | France | 162/181.8 |
| 6605 | 1/1978 | Japan | 162/128 |

OTHER PUBLICATIONS

Tappi Journal, vol. 68, No. 3, Mar. 1985, pp. 102–106, Easton, Pa.; B. Alince et al.: "Effect of Pigment Location on Paper Brightness—Prediction and Reality".

Abstract Bulletin of the Institute of Paper Chemistry, vol. 54, No. 11, May 1984, p. 1266, No. 11895, Appleton, Wis.; J. A. Bristow et al.: "Multilayer Structures in Printing Papers" and Zellstoff Papier 32, No. 6: 248–253 (Nov./Dec. 1983).

Tappi Journal, vol. 68, No. 4, Apr. 1985, pp. 74–77, Easton Pa.; J. Von Pealer et al.: "Multi-ply Manufacturing of Linerboard".

*Primary Examiner*—Karen M. Hastings

*Attorney, Agent, or Firm*—Oblon, Spivak, McClelland, Maier & Neustadt

[57] ABSTRACT

A packing paper comprising a support layer and a coating layer. The coating layer contains minerals, which give it a white pigmentation, has a content of between 25 and 50% by weight of dry materials, has a good degree of whiteness which is at least equal to 70, and has good capacity for flexographic printing.

10 Claims, No Drawings

TWO LAYER PAPER PRODUCT FOR PRINTING

BACKGROUND OF THE INVENTION

1. Field of the Invention

The present invention relates to the manufacture of packing paper which has a good capacity for printing. It aims principally at providing papers for fields of application where such a property is required without correlatively excellent mechanical properties being required.

2. Background Discussion

So-called top of the line papers are known which have a very good surface state, good capacity for printing and high mechanical resistance characteristics. For example, these are papers intended for written printing using offset or helio. In addition, papers are known whose surface state is slightly homogeneous, whose mechanical properties are high and which, at the same time, have a low capacity for printing. These are, for example, papers of the kraft paper type which are intended for use as various types of packing, in particular carrier boxes.

The papers used in packing are printed using flexography. In accordance with this method, ink is brought to a plate by means of a cylinder, with the plate in turn serving to print the paper. In this type of method, it can happen that the ink migrates into the paper instead of remaining on the surface, which causes dimensional instability of the paper and leads to a poor print reproduction. In general, this characteristic is not harmful for the applications for which it is used.

However, in the field of packing or of covering cardboard boxes, in particular, it is desirable to present packing which is pleasant to look at so as to further attract the attention of the clientele. It has been noted that a white packing which is adorned with printed designs is particularly appreciated. To achieve this result, a good print reproduction of the packing is necessary. However, a paper used in such an application need not necessarily have exceptional mechanical characteristics. For example, as applications, advertising display units for food products, by which it is sought to capture the attention of the customers, can be cited. However, the only products presently available in the packing market are those indicated previously, of the writing print type paper, which are particularly expensive. Papers which have both a very good surface state, a good capacity for printing and low mechanical properties, while retaining a white color, are not presently known.

SUMMARY OF THE INVENTION

The invention seeks to provide a paper which has such characteristics. In accordance with the invention, paper is used to mean any paper product such as paper, cardboard, etc.

The paper in accordance with the invention comprises a support layer obtained from unbleached and/or bleached cellulose fibers, which may or may not be recycled, and a coating layer with a mineral content which gives it a white pigmentation of between 25 and 50% by weight of dry matter of the layer, with the remainder being long and/or short white cellulose fibers, with the coating layer having a gram weight of between 25 g/m$^2$ and 70 g/m$^2$ and the support layer having a gram weight such that the paper has a total gram weight of between 120 g/m$^2$ and 300 g/m$^2$, with the coating layer having a degree of whiteness determined in accordance with standard NF Q 03039 of at least equal to 70 as well as a capacity for flexographic printing determined by measurement of optical density using a Macbeth RD 914 densitometer on a paper printed in blue with a high weave, greater than 0.5.

The pulps used to form the support layer can be obtained from all sorts of recovery materials, old recovery cartons or even cardboards, that is, boxes made from old papers or even old recovery newspapers.

To form the coating layer, all known types of white fibers can be used, such as eucalyptus fibers, pine fibers, etc., with said fibers being long or short.

The short fibers tend to provide homogeneous surface characteristics. When you use short fibers, one corrects poor surface properties but sacrifices mechanical characteristics, whereas the long fibers tend to improve the strain characteristics in the paper folds. Long fibers is used here to mean fibers of a length at least equal to 4 mm. Strain characteristic in the folds is defined in the following manner: it is the traction force necessary to break a test piece of paper at its fold on a metal edge. Good strain characteristics at folds are particularly advantageous in the field of packing.

In accordance with one characteristic of the invention, long and short white fibers are mixed to prepare the coating layer, in proportions such that there is at least 25% by weight of long fibers.

In order to obtain even better whiteness characteristics, it is appropriate, in accordance with another characteristic of the invention, to add an optical bluing agent as a manufacturing ingredient of the paper product in accordance with the invention. This addition can be in an amount of approximately 0.2 to 0.5% by weight of dry matter of the composition of the coating layer.

Among the minerals capable of conferring a white pigmentation to the product, talc, kaolin and titanium dioxide can for example be cited. The nature and the content of such additions can be selected and adapted in accordance with the needs of the invention.

The mineral content corresponds to a compromise between two requirements: on the one hand, to give the product appropriate whiteness characteristics, it must have a minimal value. On the other hand, it can be difficult to manufacture a product responding to the characteristics of a paper product when such content is excessive. During the manufacturing process, such content could clog the manufacturing canvasses, which causes poor drainage of the sheets. Even if one manages to make the pulp into sheets, adequate properties, particularly surface resistance, are not obtained.

To further satisfy this compromise, an additional characteristic of the invention consists of forming the coating layer such that it has a mineral content of between 35 and 45% by weight of dry matter of the layer.

The choice of minerals is a function of the desired properties of the paper. Talc is preferably chosen to obtain a paper whose surface resistance is further improved. Kaolin is also suitable. In accordance with one embodiment, synthetic fibers are present in the support layer. These fibers, such as polyethylene, in amounts of about 20–30% by weight, ameliorate adhesion properties, in particular the thermal adhesion of the support layer with other layers, such as a sheet of plastic material acting as a humidity barrier, etc. If necessary and to further improve the surface resistance of the paper, it is preferable to introduce synthetic or natural binding agents into the coating layer. Such agents assist in maintaining its internal cohesion. Such binding agents can be selected from among latex, polyvinyl alcohol, acrylates and starch. They are advantageously present in the coating layer in an amount of less than 10% by weight of dry matter of the layer, and preferably between 5 and 8%. Starch is particularly suitable since, as will be shown in the description below, it also plays an advantageous role in the method of manufacture of the paper.

A further object of the invention is a method of manufacture of a paper product in accordance with the invention.

In accordance with this method, a first layer is formed by pouring onto a manufacturing canvas a stream from a primary tank, a second layer is formed by pouring a second stream from a secondary tank, the two layers are pressed together and heated to a temperature sufficient to obtain a structure with good cohesion.

Various alternative embodiments of the method can be provided: in accordance with a first alternative, the coating layer is formed first and then the support layer on the coating layer. In accordance with a second preferred embodiment, the support layer is formed first and then the coating layer on the support layer. This alternative is preferred because if the coating layer is formed first, it is more difficult to ensure that the minerals are maintained in the coating layer during the draining operation. Consequently, the cohesion of the paper, whilst remaining satisfactory, may be reduced.

The second layer can be formed on the first layer in several ways.

In accordance with one alternative, the support layer is formed first, then the coating layer is formed on the same manufacturing canvas as the one used to form the support layer.

In accordance with another alternative, the support layer is formed first on a first canvas, the coating layer is formed on an adjacent manufacturing canvas and is then brought onto the support layer.

To carry out this method, a conventional paper machine is used. This machine comprises a manufacturing table provided with at least two tanks, with each of them providing a stream for the formation of a layer, with the two tanks being separated from one another above a same canvas, or being above two different canvasses, as well as a pressing section, a drying section and a calender.

The advantage of a binding agent in the coating layer, in particular starch, has been indicated above. This addition of starch is particularly advantageous in using the method of the invention using a single manufacturing canvas.

In this embodiment, the coating layer stream is poured onto the support layer. If the minerals do not retain sufficient cellulose fibers due to the absence of internal cohesion in the poured layer, the fibers tend to adhere to the presses during pressing. The result is a furring up of the presses which in time can lead to their deterioration and therefore necessitate more frequent replacement of the pressing components.

The presence of a binding agent therefore improves the carrying out of the method by assisting in the holding of the fibers in the coating layer. Such a problem does not generally arise in the embodiment with two manufacturing canvasses since the coating layer is already sufficiently formed when it is brought onto the support layer.

The binding agent can be introduced in two ways: in accordance with a first alternative, it is pulverized uniformly onto the support layer while said layer is not completely formed, before the pouring of the coating layer.

In accordance with a preferred alternative, the binding agent is introduced into the composition stream of the coating layer. This alternative makes the draining of the layers easier, by removing all risks of blocking of the drainage rollers.

In another alternative, the paper is subjected to a size press treatment on one or both faces with hydrophobic adjuvants. The resulting paper can be used as packaging for refigerated environments.

DETAILED DESCRIPTION OF THE INVENTION

Other characteristics and advantages of the invention will become apparent from the following detailed description of examples of embodiments of the invention.

The properties of the papers in accordance with the invention are detailed using a certain number of standardized tests which show the characteristics in accordance with the object of the invention.

1—Wax test

This test, which enables the surface resistance of the paper to be determined, is carried out in accordance with standard T 459 om 83. Numbered waxes are applied to the surface of the paper. These waxes have capabilities of adhesion to the paper and increase correlatively with the number which is assigned to them; they are then torn in order to observe the surface state of the paper. It is the highest number of a series of waxes which does not alter the surface of the paper which gives the result of the test.

2—Burst index

This is carried out in accordance with standard NFQ 03.053. It is the quotient of the maximum pressure uniformly distributed, supported by a test piece of paper, perpendicular to its surface, by the gram weight of the treated paper.

3—Bendtsen roughness

This is determined in accordance with the method of air flow at constant pressure in conformity with standard NFQ 03.049. A test piece of paper is applied under defined pressure using a metal crown against a smooth, flat and hard surface. The air arrives at a constant pressure at the center of the crown. The Bendtsen roughness is the flow of air passed between the crown and the surface of the paper.

4—Strain at folds

This is the traction force necessary for the breakage of a test piece of paper at its fold on a metal edge.

5—Iso whiteness (degree of whiteness)

This is determined in accordance with standard NFQ 03.039. The degree of whiteness is the measurement of the reflection factor diffused in in the blue of the layer of paper being studied, using a perfect reflection diffuser.

6—Flexographic printing capability

To measure this, blue is printed on the surface of the coating layer of the paper using the flexographic method. A photopolymer plate is used which is inked with an ANILOX steel cylinder. The surface of the paper is printed with water ink. The optical density is measured on a paper printed with a strong weave, that is, with a high density of the ink points, using a densitometer sold under the name MACBETH RD 914.

All the measurements of the characteristics of the paper are carried out under an atmosphere fixed at 20° C. with 65% humidity.

Unless indicated to the contrary, the following products were used:

kaolin: grade C kaolin sold by E.C. PAPER CLAYS talc standard talc 0 sold by the LUZENAC talc company with an average diameter of 10 micrometers and crumbled at 50% optical bluing agent: sold by the BAYER company under the name BLANCOPHOR starch: raw corn starch sold under the name ORISOL Attached Tables 1 and 2 list the characteristics and properties of the paper products obtained.

EXAMPLE 1

A paper was manufactured with a gram weight of 160 g/m$^2$ formed by a support layer with a gram weight of 115 g/m$^2$ made from old papers and a coating layer with a gram weight of 45 g/m$^2$ made from white fibers and mineral additions.

The pulp used to form the support layer was a pulp containing 100% old kraft recovery papers. It was poured from a primary tank onto a manufacturing canvas in the form of an aqueous dispersion with 5 g/1. The canvas advanced at a speed of 180 m/minute.

The composition comprising the second stream was poured from a secondary tank onto a second canvas. It was an aqueous dispersion with 8 g/1 which contained a mixture of long and short white fibers, with the long fibers representing one-third of the fibers. It also contained 44% kaolin, expressed by weight of dry matter (which corresponds in the paper obtained to 20 g/m$^2$ of kaolin), as well as the conventional paper additives.

The paper obtained after pressing, drying at a temperature above 90° C., which is suitable for the correct extraction of the condensates, and calendering had the characteristics indicated in Table 2.

The most significant results relate to the degree of whiteness, the wax value and the Bendtsen roughness. These last two values enable a good surface state to be characterized and good capacity for flexographic printing to be foreseen.

The Bendtsen roughness was 480. By way of comparison, that of a mottled paper was 1000 and that of a kraft paper was 1800.

EXAMPLE 2

The method of Example 1 was repeated, except that the composition of the support layer was modified to contain:

10% of old kraft papers,

20% of recycled papers from French cardboard works,

70% of recycled newspapers.

In addition, 0.4% by weight of dry matter of an optical bluing agent was added to the composition of the coating layer.

The presence of the bluing agent provided an improvement in the whiteness and the capacity for flexographic printing.

EXAMPLE 3

The method of Example 1 was repeated, except that starch was added to the composition of the coating layer, at a rate of 6.5% by weight of dry matter in order to improve the fibrous cohesion of the layer.

An improvement was noted in the wax value, as compared to Example 1, which shows the role of the starch in the fibrous cohesion of the paper.

EXAMPLE 4

The method of Example 2 was repeated, except that the kaolin was replaced with talc.

The talc content was 40% by weight of dry matter. The content of optical bluing agent was 0.3%.

The results expressed in Table 2 show that by utilizing the talc as the charge, and not utilizing a binding agent, characteristics are obtained which are comparable to those obtained with kaolin as the charge and starch as the binding agent.

EXAMPLE 5

A paper with a gram weight of 100 g/m$^2$, which was by a support layer with 85 g/m$^2$ and a coating layer with 55 g/m$^2$, was manufactured in the following manner: an aqueous dispersion with 8 g/l comprising 100% old kraft papers was poured from a primary tank onto a manufacturing canvas passing at a speed of 160 m/min.

The coating layer was then formed by pouring an aqueous dispersion with 8 g/l which contained: a mixture of long and short white fibers in a ratio such that there was one-third long fibers, 40% by weight of dry matter (22 g/m$^2$ in the coating layer) of kaolin, 6.5% by weight of dry matter of starch, onto the support layer from a secondary tank.

The results obtained show that in relation to the method using two canvasses with the same compositions, the degree of whiteness and the wax value are slightly lower.

EXAMPLE 6

The method used in Example 5 was repeated except that the kaolin was replaced with talc. It was noted that the degree of whiteness and the wax value are better with talc than with kaolin.

EXAMPLE 7

The method used in Example 6 was repeated, except that an optical bluing agent was added. It was noted, as with the two canvas method, that the presence of a bluing agent improves the whiteness properties and the capacity for flexographic printing.

EXAMPLE 8

The practice of Example 1, was observed but replacing the coating layer mix with 100% short fibers, and replacing Kaolin with talc, 40% by weight and adding 6.5% starch by weight. The table shows that use of only short fibers provides a more unified surface more receptive to imprinting, but to the deteriment of mechanical properties.

COMPARATIVE EXAMPLES

EXAMPLE 9

In this comparative example, a paper was manufactured using the one canvas method under the conditions previously described in Example 7 except that no charge, nor binder were added. The total gram weight was 140 g, of which 65 g was the coating layer.

The degree of whiteness obtained was 65 and the capacity for printing was 0.45.

These results show a clear deterioration of the characteristics of whiteness and flexographic printing capacity.

EXAMPLE 10

The method of Example 9 was repeated, except that 6% of charges were added. A degree of whiteness of 67 and a printing capacity of 0.49 were obtained, which is not as good as for the papers in accordance with the invention.

TABLE 1

| | | | Secondary Layer | | | | |
|---|---|---|---|---|---|---|---|
| | | | White Fibers | | Others | | |
| Examples | Method | Primary Layer | Long Fibers | Short Fibers | Charges | Starch | Optical Bluing Agent |
| 1 | 2 canvas | Old kraft papers 100% | 1/3 | 2/3 | Kaolin 44% | | — |
| 2 | 2 canvas | Old kraft papers 10% French cardboard 20% Newspapers 70% | 1/3 | 2/3 | Kaolin 44% | — | 0.4% |
| 3 | 2 canvas | Old kraft papers 100% | 1/3 | 2/3 | Kaolin 44% | 6.5% | — |
| 4 | 2 canvas | Old kraft papers 100% | 1/3 | 2/3 | Talc 40% | — | 0.3% |
| 5 | 2 canvas | Old kraft papers 100% | 1/3 | 2/3 | Kaolin 40% | 6.5% | — |
| 6 | 2 canvas | Old kraft papers 100% | 1/3 | 2/3 | Talc 40% | 6.5% | — |
| 7 | 2 canvas | Old kraft papers 100% | 1/3 | 2/3 | Talc 40% | 6.5% | 0.3% |
| 8 | 2 canvas | Old kraft paper 100% | 0 | 3/3 | Talc 40% | 6.5% | 0 |

TABLE 2

| | | | CHARACTERISTICS OF THE PAPERS OBTAINED | | | | | | | |
|---|---|---|---|---|---|---|---|---|---|---|
| Examples | Total gram weight g/m2 | Coating Layer gram weight g/m2 | Thickness in mm | Quire in gram weight | Degree of whiteness | Waxes | Bendtsen roughness ml/min | Burst index | Strain at folds | Printing Capacity |
| 1 | 160 | 45 | 0.200 | 1.25 | 76 | 11 | 480 | 2.60 | 240 | 0.66 |
| 2 | 160 | 45 | 0.200 | 1.25 | 78 | 11 | 480 | 2.75 | 230 | 0.68 |
| 3 | 160 | 45 | 0.200 | 1.25 | 78 | 12 | 480 | 2.75 | 230 | 0.66 |
| 4 | 160 | 45 | 0.190 | 1.18 | 79 | 12 | 500 | 2.6 | 250 | 0.68 |
| 5 | 140 | 55 | 0.220 | 1.57 | 73.5 | 11 | 500 | 1.9 | 230 | 0.66 |
| 6 | 140 | 55 | 0.220 | 1.57 | 77 | 11.5 | 650 | 2.35 | 255 | 0.66 |
| 7 | 140 | 55 | 0.165 | 1.11 | 78 | 11.5 | 480 | 2.53 | 225 | 0.68 |
| 8 | 140 | 55 | 0.218 | 1.56 | 78 | 8 | 600 | 2.30 | 230 | 0.70 |

What is claimed as new and desired to be secured by Letters Patent of the United States is:

1. A paper product comprising a support layer and a coating layer, both based on cellulose fibers, wherein:

the support layer comprises unbleached and/or bleached, recycled or non-recycled cellulose fibers, the coating layer comprises at least one mineral selected from the group consisting of talc, kaolin, and $TiO_2$ which gives it a white pigmentation, in an amount of between 25 and 50% by weight of dry matter of the layer, the remainder being long and short white cellulose fibers, with at least 25% by weight of the fibers in teh layer being long fibers having a length of greater than 4 mm, the coating layer has a gram weight of between 25 $g/m^2$ and 70 $g/m^2$, the support layer has a gram weight such that the paper product has a total gram weight of between 120 $g/m^2$ and 300 $g/m^2$, the coating layer has a degree of whiteness, determined in accordance with standard NFQ 03.039, of at least equal to 70 and the coating layer has a capacity for flexographic printing which is at least 0.6, as determined by measurement of the optical density using a MACBETH RD 914 densitometer on a product printed in blue with a strong weave.

2. The product in accordance with claim 1, wherein the coating layer contains said mineral in an amount of between 35% and 45% by weight of dry matter of the layer.

3. The product in accordance with claim 2, wherein said mineral is talc.

4. The product in accordance with claim 1, wherein the coating layer contains an optical bluing agent in an amount of 0.2% to 0.5% by weight of dry matter of the layer.

5. The product in accordance with claim 1, wherein the coating layer contains a synthetic or natural binding agent.

6. The product in accordance with claim 5, wherein said binding agent is present in an amount of less than 10% by weight of dry matter of the layer.

7. The product in accordance with claim 6, wherein said binding agent is present in an amount of from 5 to 8% by weight.

8. The product in accordance with claim 6, wherein said binding agent is starch.

9. The product of claim 1, wherein said support layer further comprises synthetic fibers.

10. The product of claim 1, wherein at least one major face of said product contains a hydrophobic adjuvant which has been applied by a size-press treatment.

* * * * *